US011161581B2

(12) United States Patent
Barratt

(10) Patent No.: US 11,161,581 B2
(45) Date of Patent: Nov. 2, 2021

(54) MARINE OUTBOARD MOTOR WITH A TRANSMISSION LUBRICATION SYSTEM AND LUBRICANT FILTER

(71) Applicant: COX POWERTRAIN LIMITED, Shoreham-By-Sea (GB)

(72) Inventor: James Barratt, Shoreham-By-Sea (GB)

(73) Assignee: COX POWERTRAIN LIMITED, Shoreham-by-Sea (GB)

( * ) Notice: Subject to any disclaimer, the term of this patent is extended or adjusted under 35 U.S.C. 154(b) by 0 days.

(21) Appl. No.: 16/796,126

(22) Filed: Feb. 20, 2020

(65) Prior Publication Data

US 2020/0283109 A1 Sep. 10, 2020

(30) Foreign Application Priority Data

Mar. 7, 2019 (GB) ..... 1903073

(51) Int. Cl.
*B63H 20/14* (2006.01)
*B63H 20/00* (2006.01)
*B63H 20/32* (2006.01)

(52) U.S. Cl.
CPC ..... *B63H 20/002* (2013.01); *B63H 20/14* (2013.01); *B63H 2020/323* (2013.01)

(58) Field of Classification Search
CPC . B63H 20/002; B63H 20/14; B63H 2020/323
See application file for complete search history.

(56) References Cited

U.S. PATENT DOCUMENTS 2,663,424 A * 12/1953 Bynum ..... F16N 39/06 210/377
4,563,127 A * 1/1986 Flandin-Blety ..... F03B 13/04 415/184
5,980,340 A 11/1999 Okamoto
6,261,455 B1 7/2001 Brown et al.
2003/0066711 A1 4/2003 Saiga et al.
2006/0160441 A1 7/2006 Asakaze et al.
2008/0009207 A1 1/2008 Okabe

FOREIGN PATENT DOCUMENTS

JP S61-205597 9/1986
JP H10-339124 12/1998

OTHER PUBLICATIONS

Search and Examination Report issued in Appl. No. GB1903073.3 (dated 2019).
Search Report & Written Opinion issued in Int'l App. No. PCT/GB2020/050518 (dated 2020).

* cited by examiner

*Primary Examiner* — Stephen P Avila
(74) *Attorney, Agent, or Firm* — Barnes & Thornburg LLP

(57) ABSTRACT

A marine outboard motor for a marine vessel is provided. The marine outboard motor includes an internal combustion engine, a drive shaft configured to transmit a drive force from the internal combustion engine, a propeller shaft, and a drive transmission configured to transmit the drive force from the drive shaft to the propeller shaft. The motor also includes a lubrication system configured to convey lubricant along a lubricant flow path to lubricate one or both of the drive transmission and the drive shaft, and a lubricant filter provided along the lubricant flow path and configured to remove solid contaminants from the lubricant as it flows along the lubricant flow path. The lubricant filter is configured to be driven by the drive shaft.

18 Claims, 4 Drawing Sheets

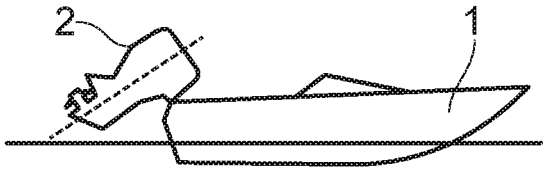
FIG. 2a
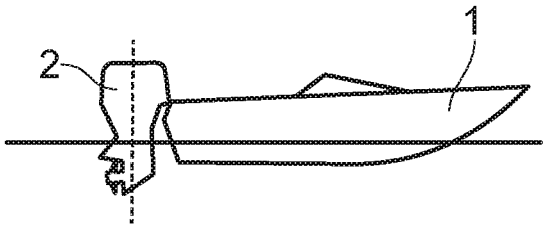
FIG. 2b
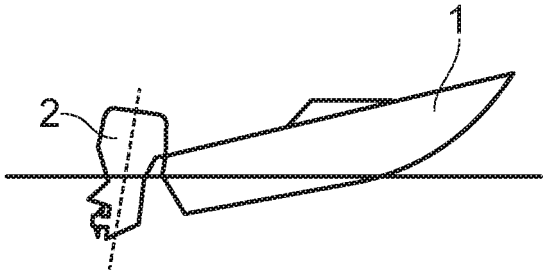
FIG. 2c
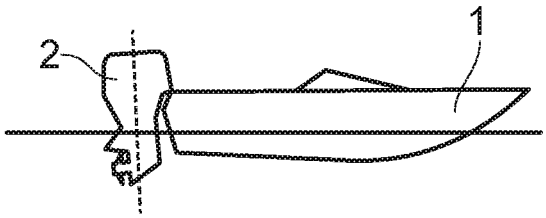
FIG. 2d
FIG. 2

MARINE OUTBOARD MOTOR WITH A TRANSMISSION LUBRICATION SYSTEM AND LUBRICANT FILTER

CROSS REFERENCE TO RELATED APPLICATIONS

This application claims priority to United Kingdom patent application no. 1903073.3, filed Mar. 7, 2019. The disclosure set forth in the referenced application is incorporated herein by reference in its entirety.

TECHNICAL FIELD

The present invention relates to a marine outboard motor with a lubricant filter. While this application relates to marine outboard motors, the teachings may also be applicable to any other internal combustion engine.

BACKGROUND

At present, the outboard engine market is dominated by petrol engines. Petrol engines are typically lighter than their diesel equivalents. However, a range of users, from military operators to super-yacht owners, have begun to favour diesel outboard motors because of the improved safety of diesel fuel, due to its lower volatility, and to allow fuel compatibility with the mother ship. Furthermore, diesel is a more economical fuel source with a more readily accessible infrastructure for marine applications.

In outboard engines, in order to extend the life cycle of the outboard, the drive shaft and the transmission gear housing, in which the propeller shaft is mounted, is required to be lubricated. Typically, oil is used as the lubricant for outboards. Over continued lubrication of the components of the outboard motor, solid contaminants washed away from the components begin to build up within the oil. A problem with known outboard engines is that their components, such as gear transmissions, can have a relatively short service life, which can be at least partially attributed to a build-up of solid contaminants or debris in this lubricating oil.

The present invention seeks to provide an improved marine outboard motor which overcomes or mitigates one or more problems associated with the prior art.

SUMMARY OF THE INVENTION

According to a first aspect of the present invention, there is provided a marine outboard motor for a marine vessel, the marine outboard motor comprising: an engine assembly comprising an internal combustion engine; a drive shaft configured to transmit a drive force from the internal combustion engine; a propeller shaft; a drive transmission configured to transmit the drive force from the drive shaft to the propeller shaft; a lubrication system configured to convey lubricant along a lubricant flow path to lubricate one or both of the drive transmission and the drive shaft; and a lubricant filter provided along the lubricant flow path and configured to remove solid contaminants from the lubricant as it flows along the lubricant flow path, wherein the lubricant filter is configured to be driven by the drive shaft.

This arrangement is advantageous as utilises the motion of the drive shaft to actively filter debris from the lubricant (e.g. oil) as it flows along the lubricant flow path. This configuration improves service life of the components of the transmission, and so of the outboard motor, by actively reducing contaminants in the lubricant.

The lubricant filter may be configured to be indirectly driven by the drive shaft via a drive mechanism coupled to the drive shaft.

This arrangement provides a compact packaging of a filter system which is more easily packaged within the motor, as it enables the filter to be offset from the drive shaft and positioned in a more convenient location, rather than requiring the filter to be mounted directly onto the drive shaft.

The drive mechanism may have a gear ratio of greater that 1:1.

The use of such a 'step-up' drive allows the centrifugal force generated within the filter to be increased for a given rotational speed of the drive shaft. This can improve the efficiency with which smaller contaminants are removed from the lubricant by the filter.

The lubrication system may be configured to convey lubricant along a lubricant flow path to lubricate the drive mechanism.

The marine outboard motor may comprise a cooling system for cooling the internal combustion engine. The cooling system may comprise a water pump configured to propel drawn water along a coolant flow path for cooling the internal combustion engine. The water pump may be configured to be driven by the drive shaft via the drive mechanism, and wherein the lubricant filter is configured to driven by the water pump.

With this arrangement, the water pump and the lubricant filter are driven by the same drive mechanism. This avoids the need for separate drive mechanisms and so advantageously results in a reduction in losses in transmission, which can improve the efficiency of the marine outboard motor.

The water pump comprises a centrifugal water pump.

The water pump may comprise a water pump output shaft, and the lubricant filter may comprise a filter drive shaft which is configured to be driven by the water pump output shaft.

This arrangement advantageously results in further reduction in losses in transmission, which improves the efficiency of the marine outboard motor.

The filter drive shaft may be co-axial with, and directly connected to, the water pump output shaft.

The drive mechanism may comprise a water pump drive shaft which is co-axial with, and directly connected to, the water pump output shaft.

The water pump drive shaft, water pump output shaft and the filter drive shaft may all be defined by a single shaft.

The lubricant filter may be connected to the water pump via mechanical fuse.

Connecting the two via a mechanical fuse ensures that the connection is configured to fail above a pre-determined level of torque. This arrangement ensures that the connection between the water pump drive shaft and the filter drive shaft is broken should the filter become jammed, in order to prevent damage to the water pump and or pump drive transmission.

The drive mechanism may comprise a drive gear mounted concentrically on the drive shaft and a driven gear mounted concentrically on the water pump drive shaft. The drive gear and driven gear may be in meshing engagement.

Providing a drive gear that is rotatably fixed onto the drive shaft ensures that the motive power transmitted by the drive shaft can be used to drive the cooling system.

The lubricant filter may be a centrifugal lubricant filter configured to be driven by the drive shaft.

The marine outboard motor may comprise a transmission casing within which the propeller shaft and the transmission drive are at least partly housed. The transmission casing may define a lubricant reservoir of the lubrication system.

The lubrication system may comprise a lubricant pump configured to draw lubricant from the fluid reservoir during use and to pump drawn lubricant along the lubricant flow path to at least one rotating component located above the fluid reservoir.

The driveshaft may extend in a vertical direction when the marine outboard motor is vertical.

The engine block may comprise a single cylinder. Preferably, the engine block comprises a plurality of cylinders.

As used herein, the term "engine block" refers to a solid structure in which at least one cylinder of the engine is provided. The term may refer to the combination of a cylinder block with a cylinder head and crankcase, or to the cylinder block only. The engine block may be formed from a single engine block casting. The engine block may be formed from a plurality of separate engine block castings which are connected together, for example using bolts.

The engine block may comprise a single cylinder bank.

The engine block may comprise a first cylinder bank and a second cylinder bank. The first and second cylinder banks may be arranged in a V configuration.

The engine block may comprise three cylinder banks. The three cylinder banks may be arranged in a broad arrow configuration. The engine block may comprise four cylinder banks. The four cylinder banks may be arranged in a W or double-V configuration.

The internal combustion engine may be arranged in any suitable orientation. Preferably, the internal combustion engine is a vertical axis internal combustion engine. In such an engine, the internal combustion engine comprises a crankshaft which is mounted vertically in the engine.

The internal combustion engine may be a petrol engine. Preferably, the internal combustion engine is a diesel engine. The internal combustion engine may be a turbocharged diesel engine.

According to a second aspect of the present invention, there is provided a marine vessel comprising the marine outboard motor of the first aspect.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

Further features and advantages of the present invention will be further described below, by way of example only, with reference to the accompanying drawings in which:

FIG. 2A shows a schematic representation of a marine outboard motor in its tilted position;

FIGS. 2B to 2D show various trimming positions of the marine outboard motor and the corresponding orientation of the marine vessel within a body of water;

DETAILED DESCRIPTION

Figure 1:
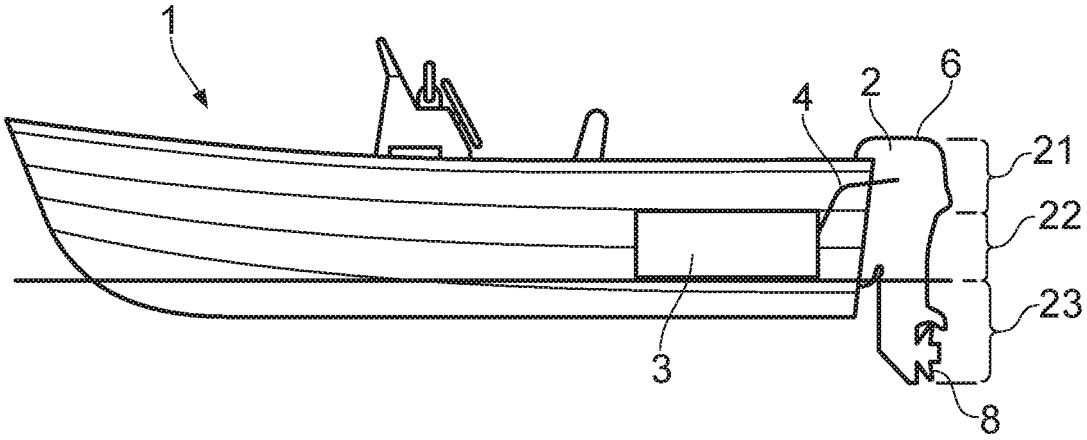
FIG. 1 is a schematic side view of a light marine vessel provided with a marine outboard motor.

Referring firstly to FIG. 1, there is shown a schematic side view of a marine vessel 1 with a marine outboard motor 2. The marine vessel 1 may be any kind of vessel suitable for use with a marine outboard motor, such as a tender or a scuba-diving boat. The marine outboard motor 2 shown in FIG. 1 is attached to the stern of the vessel 1. The marine outboard motor 2 is connected to a fuel tank 3, usually received within the hull of the marine vessel 1. Fuel from the reservoir or tank 3 is provided to the marine outboard motor 2 via a fuel line 4. Fuel line 4 may be a representation for a collective arrangement of one or more filters, low pressure pumps and separator tanks (for preventing water from entering the marine outboard motor 2) arranged between the fuel tank 3 and the marine outboard motor 2.

As will be described in more detail below, the marine outboard motor 2 is generally divided into three sections, an upper-section 21, a mid-section 22, and a lower-section 23. The mid-section 22 and lower-section 23 are often collectively known as the leg section, and the leg houses the exhaust system. A propeller 8 is rotatably arranged on a propeller shaft at the lower-section 23, also known as the gearbox, of the marine outboard motor 2. Of course, in operation, the propeller 8 is at least partly submerged in water and may be operated at varying rotational speeds to propel the marine vessel 1.

Typically, the marine outboard motor 2 is pivotally connected to the stern of the marine vessel 1 by means of a pivot pin. Pivotal movement about the pivot pin enables the operator to tilt and trim the marine outboard motor 2 about a horizontal axis in a manner known in the art. Further, as is well known in the art, the marine outboard motor 2 is also pivotally mounted to the stern of the marine vessel 1 so as to be able to pivot, about a generally upright axis, to steer the marine vessel 1.

Tilting is a movement that raises the marine outboard motor 2 far enough so that the entire marine outboard motor 2 is able to be raised completely out of the water. Tilting the marine outboard motor 2 may be performed with the marine outboard motor 2 turned off or in neutral. However, in some instances, the marine outboard motor 2 may be configured to allow limited running of the marine outboard motor 2 in the tilt range so as to enable operation in shallow waters. Marine engine assemblies are therefore predominantly operated with a longitudinal axis of the leg in a substantially vertical direction. As such, a crankshaft of an engine of the marine outboard motor 2 which is substantially parallel to a longitudinal axis of the leg of the marine outboard motor 2 will be generally oriented in a vertical orientation during normal operation of the marine outboard motor 2, but may also be oriented in a non-vertical direction under certain operating conditions, in particular when operated on a vessel in shallow water. A crankshaft of a marine outboard motor 2 which is oriented substantially parallel to a longitudinal axis of the leg of the engine assembly can also be termed a vertical crankshaft arrangement. A crankshaft of a marine outboard motor 2 which is oriented substantially perpendicular to a longitudinal axis of the leg of the engine assembly can also be termed a horizontal crankshaft arrangement.

As mentioned previously, to work properly, the lower-section 23 of the marine outboard motor 2 needs to extend into the water. In extremely shallow waters, however, or when launching a vessel off a trailer, the lower-section 23 of the marine outboard motor 2 could drag on the seabed or boat ramp if in the tilted-down position. Tilting the marine outboard motor 2 into its tilted-up position, such as the position shown in FIG. 2A, prevents such damage to the lower-section 23 and the propeller 8.

By contrast, trimming is the mechanism that moves the marine outboard motor 2 over a smaller range from a fully-down position to a few degrees upwards, as shown in the three examples of FIGS. 2B to 2D. Trimming helps to direct the thrust of the propeller 8 in a direction that will provide the best combination of fuel efficiency, acceleration and high speed operation of the marine vessel 1.

When the vessel 1 is on a plane (i.e. when the weight of the vessel 1 is predominantly supported by hydrodynamic lift, rather than hydrostatic lift), a bow-up configuration results in less drag, greater stability and efficiency. This is generally the case when the keel line of the boat or marine vessel 1 is up about three to five degrees, such as shown in FIG. 2B for example.

Too much trim-out puts the bow of the vessel 1 too high in the water, such as the position shown in FIG. 2C. Performance and economy, in this configuration, are decreased because the hull of the vessel 1 is pushing the water and the result is more air drag. Excessive trimming-out can also cause the propeller to ventilate, resulting in further reduced performance. In even more severe cases, the vessel 1 may hop in the water, which could throw the operator and passengers overboard.

Trimming-in will cause the bow of the vessel 1 to be down, which will help accelerate from a standing start. Too much trim-in, shown in FIG. 2D, causes the vessel 1 to "plough" through the water, decreasing fuel economy and making it hard to increase speed. At high speeds, trimming-in may even result in instability of the vessel 1.

Figure 3:
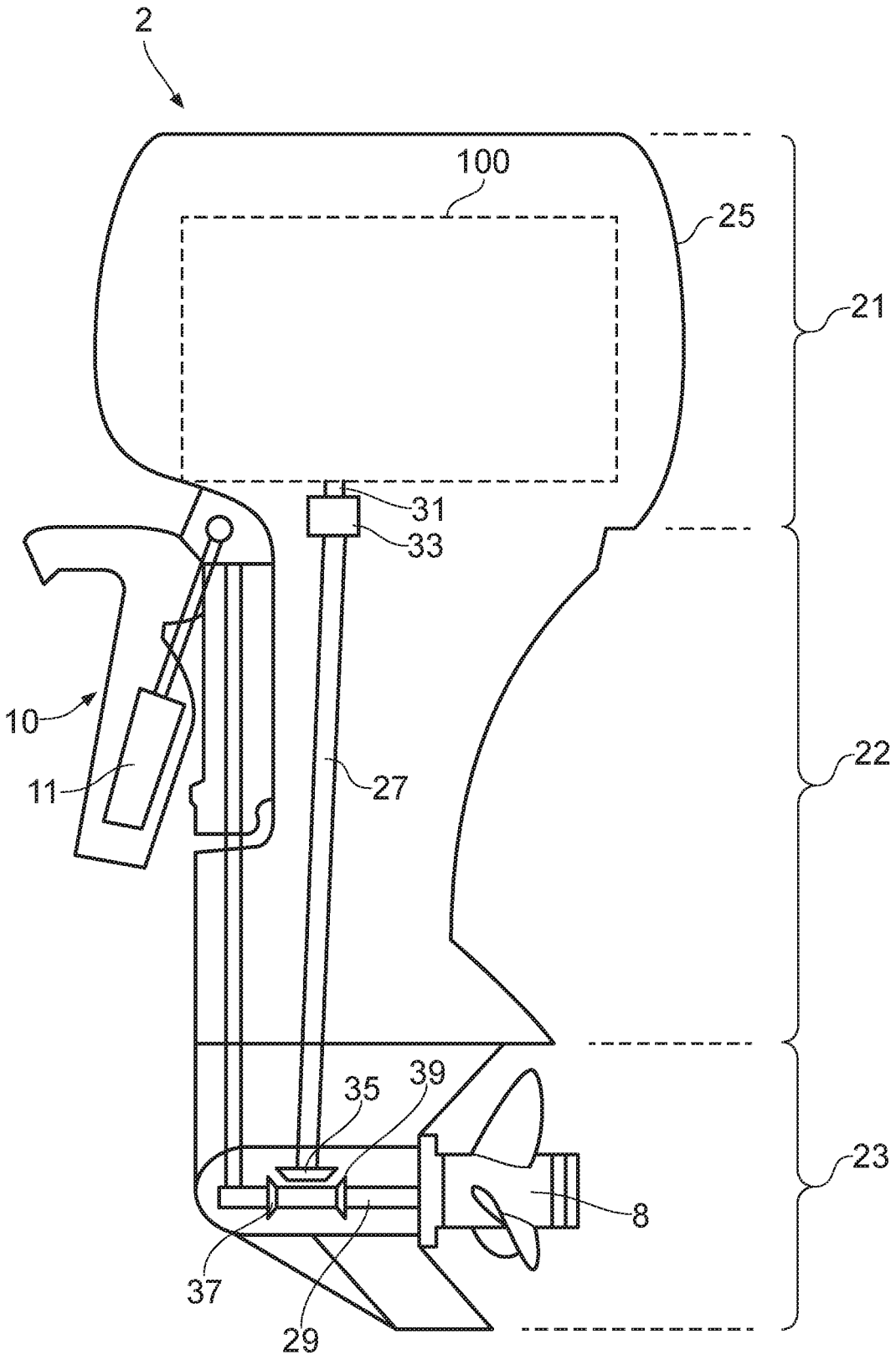
FIG. 3 shows a schematic cross-section of a marine outboard motor according to an embodiment.

Turning to FIG. 3, there is shown a schematic cross-section of an outboard motor 2 according to an embodiment of the present invention. The outboard motor 2 comprises a tilt and trim mechanism 10 for performing the aforementioned tilting and trimming operations. In this embodiment, the tilt and trim mechanism 10 includes a hydraulic actuator 11 that can be operated to tilt and trim the outboard motor 2 via an electric control system. Alternatively, it is also feasible to provide a manual tilt and trim mechanism, in which the operator pivots the outboard motor 2 by hand rather than using a hydraulic actuator.

As mentioned above, the outboard motor 2 is generally divided into three sections. An upper-section 21, also known as the powerhead, includes an internal combustion engine 100 for powering the marine vessel 1. A cowling 25 is disposed around the engine 100. The mid-section 22 and lower-section 23 form an exhaust system, which defines an exhaust gas flow path for transporting exhaust gases from the internal combustion engine 100 and out of the outboard motor 2.

Adjacent to, and extending below, the upper-section 21 or powerhead, there is provided a mid-section 22 and a lower section 23. The lower-section 23 extends adjacent to and below the mid-section 22, and the mid-section 22 connects the upper-section 21 to the lower-section 23. Together, the mid-section 22 and the lower-section 23 form the leg section of the marine outboard motor 2. The mid-section 22 houses a drive shaft 27 which extends in a vertical direction between the combustion engine 100 and the propeller shaft 29 and is connected to a crankshaft 31 of the combustion engine via a floating connector 33 (e.g. a splined connection). In this way, the drive shaft 27 is configured to transmit a drive force from the internal combustion engine 100. At the lower end of the drive shaft 27, a gear box/drive transmission is provided that supplies the rotational energy of the drive shaft 27 to the propeller 8 in a horizontal direction. The gear box/drive transmission includes a transmission casing 61 in which at least a part of the propeller shaft 29 is housed. The gear box/drive transmission is configured to transmit the drive force from the drive shaft 27 to the propeller shaft 29. In more detail, the bottom end of the drive shaft 27 may include a bevel gear 35 connected to a pair of bevel gears 37, 39 that are rotationally connected to the propeller shaft 29 of the propeller 8.

As shown schematically in FIG. 3, the marine outboard motor 2 is provided with a cooling system to convey water drawn from a body of water in which the marine outboard motor is operated in use along a coolant flow path 43 extending through the housing 6 to the combustion engine 100. The water is propelled around the coolant flow path 43 by the at least one water pump (see FIGS. 4 and 5) in order to cool the engine 100.

The housing 6 of the marine outboard motor 2 includes one or more apertures intended to be submerged, in use, into a body of water in which the marine outboard motor 2 is operated. Put another way, in use, water from a body of water in which the marine outboard motor 2 is operated passes into the housing 6 via one or more apertures in the housing 6 that are positioned below the waterline of the body of water, with the marine vessel 1 at rest. As will be discussed later, in the arrangement shown the one or more apertures are provided on the lower-section 23.

In the illustrated embodiment, the housing 6 includes a first inlet 45 in the lower-section 23. Although not illustrated, the housing 6 is provided with second, third and fourth inlets, with two inlets on each opposing side of the housing 6. In alternative arrangements, the coolant flow path 43 may include any suitable number of inlets (e.g. one, two, five etc.) and/or the one or more of the inlets may be provided on the mid-section 22.

This arrangement of apertures positioned below the water line, in use, results in water in which the marine outboard motor 2 is operated being drawn into a chamber 52 within the housing 6. In this way, the chamber 52 within the housing 6 is continuously provided with drawn water from the body of water in which the marine outboard motor 2 is operated.

Figure 4:
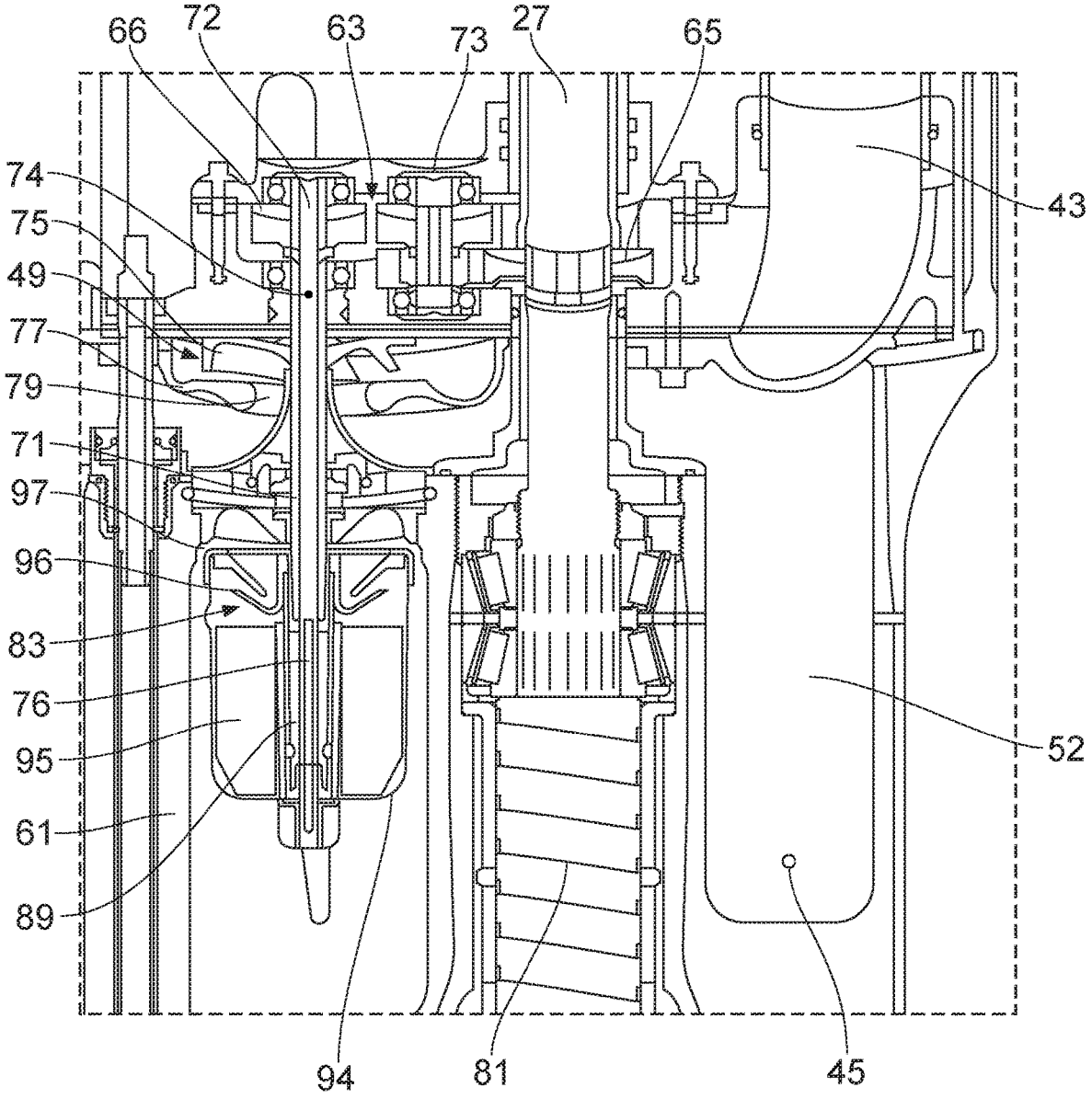
FIG. 4 shows a schematic cross-section of the mid-section and lower-section of the marine outboard motor of FIG. 3.

Referring now to FIG. 4, the mid-section 22 and lower-section 23 are illustrated.

The cooling system includes a centrifugal water pump 49 which is located in the leg-section 21 of the marine outboard motor 2. In use, water from the body of water in which the marine outboard motor 2 is used, enters into the chamber 52 of the housing 6 via the inlets 45. As with other types of centrifugal pump, the water pump 49 comprises a vaned circular disc, or impeller 75, which is concentrically mounted to a water pump drive shaft 71 and the impellor 75 is configured to spin around its central axis within a pump housing 77.

The rotating impeller 75 accelerates the drawn water as the drawn water moves across the impeller 75, generating a pressure differential across the water pump 49. This causes a pressurised flow of drawn water to be directed along the coolant flow path 43 via the water pump 49 to the internal combustion engine 100. In order to absorb heat from the internal combustion engine 100, the drawn water flows along at least one coolant passage (not shown) in the internal combustion engine 100 before returning to the body of water via one or more drain lines (not shown). In this way, the cooling system is configured to draw water into the housing 6 and to propel the drawn water along the coolant flow path 43 to the internal combustion engine 100.

In the illustrated embodiment, the water pump 49 is a centrifugal pump that is arranged to be separate from the drive shaft 27 (i.e. not mounted directly thereto) and is configured to be driven by the drive shaft 27. That is, the impellor 75 of the water pump 49 is indirectly driven by rotation of the drive shaft 27. It will be appreciated that alternative types of water pump may be used in the marine outboard motor 2, for example a flexible impeller pump. It will also be appreciated that that in alternative arrangements the water pump 49 may be directly mounted to the drive shaft 27 or to a sleeve around the drive shaft 27, discussed in more detail below.

In order to drive the water pump 49, the marine outboard motor 2 includes a drive mechanism 63 that is connected to the drive shaft 27. The drive mechanism 63 is configured to supply the rotational energy of the drive shaft 27 to the water pump 49 to drive the impellor 75. The drive mechanism 63 is disposed in a drive mechanism housing 73.

In this example, the water pump 49 is coupled to the drive shaft 27 by a drive mechanism is configured to transfer a drive force from the drive shaft 27 to the pump 49. The drive mechanism 63 includes a drive gear 65 mounted concentrically on the drive shaft 27 and a driven gear 66 mounted concentrically on the water pump drive shaft 71, wherein the drive gear 65 and driven gear 66 are in meshing engagement.

In some embodiments, the water pump 49 is coupled to the drive shaft 27 by a drive mechanism 63 having a gear ratio of greater than 1:1. Such a 'step-up drive' can be advantageous where the typical rotational speed of the drive shaft 27 is unable to provide a sufficient flow rate through the water pump 49, for example where the diameter of the water pump 49 is limited by available space.

In use, water from the body of water in which the motor is used is supplied to the central region of the pump impeller 75 via the pump inlet port 79 while the impeller 75 is rotated by the drive shaft 27 via the drive gear 65. The rotating impeller 75 accelerates the water as the water moves radially across the impeller 75, generating a pressure differential across the pump 49 and causing a pressurised flow of water to be directed to the coolant passage of the internal combustion engine 100. As the coolant water flows around the coolant passage of the internal combustion engine 100, it absorbs heat from the engine 100 before draining and returning to the body of water via a coolant drain port (not shown).

The marine outboard motor 2 is provided with a lubrication system for lubricating the drive transmission. The lubrication system is configured to convey lubricant (e.g. oil) along a lubricant flow path to lubricate the drive transmission and/or the drive shaft 27. The lubrication system is provided with a lubricant filter 83 along the lubricant flow path so as to remove solid contaminants from the lubricant in-situ.

During operation of the marine outboard motor 2, the lubricant flows along the lubricant flow path in order to flow over different components housed within the transmission casing 61. In addition to lubricating the components within the transmission casing 61, such as bevel gears 35, 37, 39, the lubricant also cleans the components by the washing away of solid contaminants/debris. In this way, the lubricant is able to both lubricate and clean the components housed within the transmission casing 61.

Over time, this process results in the build of the solid contaminants within the lubricant. In order to mitigate this, the lubrication system includes a lubricant filter 83 provided along the lubricant flow path. The lubricant filter 83 is configured to filter the lubricant as it flows along the lubricant flow path, in order to remove solid contaminants suspended within the lubricant.

In the arrangement shown, the filter is provided in the form of a centrifugal lubricant filter 83. In order to utilise the motive force of the drive shaft 27, the centrifugal lubricant filter 83 is configured to be indirectly driven by the drive shaft 27. In the arrangement shown, the centrifugal lubricant filter 83 is configured to be indirectly driven by the drive shaft 27 via the drive mechanism coupled to the drive shaft 27. This arrangement removes the need for a separate drive arrangement for the lubricant filter 83.

In the illustrated embodiment, the centrifugal lubricant filter 83 is configured to driven by the water pump 49. This arrangement reduces losses in transmission, by only providing a single connection to the drive shaft 27 for both the centrifugal lubricant filter 83 and the water pump 49.

As discussed above, the water pump 49 includes an impellor 75 mounted concentrically onto a water pump drive shaft 71. The water pump drive shaft 71 is separate from the drive shaft 27 and is configured to be driven by the drive shaft 27. In the arrangement shown, the centrifugal lubricant filter 83 is configured to be driven by the water pump drive shaft 71.

The centrifugal lubricant filter 83 includes a filter drive shaft 93 configured to be driven by the water pump drive shaft 71. In the arrangement shown, the water pump 49 includes a water pump output shaft, and the lubricant filter 83 includes a filter drive shaft 93 which is configured to be driven by the water pump output shaft.

The filter drive shaft 89 is positioned substantially centrally within a filter housing 94 and configured to be driven by the water pump drive shaft. The filter drive shaft 89 is aligned axially with and is rotationally fixed relative to the water pump drive shaft 71. The filter housing 94 acts as a lubricant reservoir into which the lubricant can flow to enable the solid contaminants to be filtered therefrom.

In order to prevent damage occurring to the water pump 49, e.g. when the lubricant filter 83 becomes jammed, the filter drive shaft 89 may be mounted to the water pump drive shaft 71 via mechanical fuse (not shown). Connecting the two shafts 71, 89 via a mechanical fuse ensures that the connection is configured to fail above a pre-determined level of torque (i.e. when one of the shafts becomes jammed).

The centrifugal lubricant filter 83 includes a rotor 95 that mounted to the filter drive shaft 89, such that the rotor 95 rotates within the housing 94 to drive the centrifugal lubricant filter 83. The centrifugal lubricant filter 83 is also provided with a separation disc 96 configured to filter the solid contaminants from the lubricant. The separation disc 96 is provided in the form of cone extending outwardly from the filter drive shaft 89 and is angled upwardly (it is angled in a direction towards the water pump 49). An upper surface of the separation disc 96 is spaced apart from the transmission casing 61 so as to define the outlet 97 of the centrifugal lubricant filter 83.

Travel of the lubricant along the lubricant flow path will now be discussed.

It will be appreciated that various different flow paths may be provided for the lubricant.

In the arrangement shown, the lubricant travels along the drive shaft 27 (e.g. away from the propeller shaft 29), which this movement is driven by an Archimedes-style screw pump 81 on the radially outer surface of the input shaft 27.

Through continued operation of the pump 81, the lubricant is driven upwards along the outer surface of the drive shaft 27 towards the drive mechanism housing 73. In this way, the lubricant is able to flow into the drive mechanism housing 73 in order to lubricate the gears 65, 66 of the drive mechanism 63.

As lubricant continues to flow into the drive mechanism housing 73, the volume of lubricant within the housing 73 builds up.

The water pump drive shaft 71 is provided with a shaft aperture 74 extending from the outer surface of the water pump drive shaft 71 to a central bore 72 extending axially along the water pump drive shaft 71. As the lubricant level builds within the drive mechanism housing 73, it will reach a predetermined level and flow into the shaft aperture 74.

In this way, the lubricant is able to enter the bore 72 of the water pump drive shaft 71 in order to flow lubricant filter housing 94. In the arrangement shown, the filter drive shaft 89 is aligned axially with and is rotationally fixed relative to the water pump drive shaft 71, and the lubricant flows from the bore 72 into and along a bore 76 extending through the filter drive shaft 89, and into the filter housing 94.

In alternative arrangements, it will be appreciated that the lubricant flow path may bypass the drive mechanism housing 73. In such an arrangement, as discussed above, the lubricant may travel along the drive shaft 27 driven by an Archimedes-style screw pump 81 on the radially outer surface of the input shaft 27. An inlet passage may be provided such that the lubricant is able to flow directly from the drive shaft 27 into the lubricant filter 83.

Rotation of the rotor 95 works to separate the heavier solid contaminants from the lighter lubricant. Through the centrifugal forces applied by the rotation of the rotor 95, the denser solid contaminants are urged radially outwardly. Moreover, due their weight, the contaminants settle on the bottom surface of the housing 94. In this way, the solid contaminants are retained within the lubricant filter 83. The lubricant filter 83 includes a separation disc 96, which diverts the separated (or filtered) lubricant radially outward before flowing out of the centrifugal lubricant filter 83 via the outlet 97. In this way, the solid contaminants separated from the lubricant is retained within the lubricant filter 83 and the filtered lubricant is able to exit the centrifugal lubricant filter 83 via the exit 97 to travel towards the propeller shaft 29.

Although the invention has been described above with reference to one or more preferred embodiments, it will be appreciated that various changes or modifications may be made without departing from the scope of the invention as defined in the appended claims.

The invention claimed is:

1. A marine outboard motor for a marine vessel, the marine outboard motor comprising:

an engine assembly comprising an internal combustion engine;

a drive shaft configured to transmit a drive force from the internal combustion engine;

a propeller shaft;

a drive transmission configured to transmit the drive force from the drive shaft to the propeller shaft;

a lubrication system configured to convey lubricant along a lubricant flow path to lubricate one or both of the drive transmission and the drive shaft; and a lubricant filter provided along the lubricant flow path and configured to remove solid contaminants from the lubricant as it flows along the lubricant flow path, wherein the lubricant filter is configured to be driven by the drive shaft.

2. The marine outboard motor according to claim 1, wherein the lubricant filter is configured to be indirectly driven by the drive shaft via a drive mechanism coupled to the drive shaft.

3. The marine outboard motor according to claim 2, wherein the drive mechanism has a gear ratio of greater that 1:1.

4. The marine outboard according to claim 2, wherein the lubrication system is configured to convey lubricant along a lubricant flow path to lubricate the drive mechanism.

5. The marine outboard motor according to claim 2, comprising a cooling system for cooling the internal combustion engine, the cooling system comprising a water pump configured to propel drawn water along a coolant flow path for cooling the internal combustion engine, wherein the water pump is configured to be driven by the drive shaft via the drive mechanism, and wherein the lubricant filter is configured to driven by the water pump.

6. The marine outboard motor according to claim 5, wherein the water pump comprises a centrifugal water pump.

7. The marine outboard motor according to claim 5, wherein the water pump comprises a water pump output shaft, and wherein the lubricant filter comprises a filter drive shaft which is configured to be driven by the water pump output shaft.

8. The marine outboard motor according to claim 7, wherein the filter drive shaft is co-axial with, and directly connected to, the water pump output shaft.

9. The marine outboard motor according to claim 8, wherein the drive mechanism comprises a water pump drive shaft which is co-axial with, and directly connected to, the water pump output shaft.

10. The marine outboard motor according to claim 9, wherein the water pump drive shaft, water pump output shaft and the filter drive shaft are all defined by a single shaft.

11. The marine outboard motor according to claim 5, wherein the lubricant filter is connected to the water pump via mechanical fuse.

12. The marine outboard motor according to claim 5, wherein the drive mechanism comprises a drive gear mounted concentrically on the drive shaft and a driven gear mounted concentrically on the water pump drive shaft, wherein the drive gear and driven gear are in meshing engagement.

13. The marine outboard motor according to claim 1, wherein the lubricant filter is a centrifugal lubricant filter configured to be driven by the drive shaft.

14. The marine outboard motor according to claim 1, further comprising a transmission casing within which the propeller shaft and the transmission drive are at least partly housed, wherein the transmission casing defines a lubricant reservoir of the lubrication system.

15. The marine outboard motor according to claim 14, wherein the lubrication system further comprises a lubricant pump configured to draw lubricant from the fluid reservoir during use and to pump drawn lubricant along the lubricant flow path to at least one rotating component located above the fluid reservoir.

16. The marine outboard motor according to claim 1, wherein the driveshaft extends in a vertical direction when the marine outboard motor is vertical.

17. The marine outboard motor according to claim 1, wherein the internal combustion engine is a diesel engine.

18. A marine vessel comprising the marine outboard motor of claim 1.

* * * * *